US007740714B2

(12) United States Patent
Sati et al.

(10) Patent No.: US 7,740,714 B2
(45) Date of Patent: Jun. 22, 2010

(54) METHOD FOR PREPARING RADIALLY ANISOTROPIC MAGNET

(75) Inventors: Koji Sati, Echizen (JP); Mitsuo Kitagawa, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 534 days.

(21) Appl. No.: 11/662,467

(22) PCT Filed: Nov. 29, 2006

(86) PCT No.: PCT/JP2006/323771

§ 371 (c)(1),
(2), (4) Date: Mar. 12, 2007

(87) PCT Pub. No.: WO2007/069454

PCT Pub. Date: Jun. 21, 2007

(65) Prior Publication Data

US 2009/0053091 A1 Feb. 26, 2009

(30) Foreign Application Priority Data

Dec. 13, 2005 (JP) ..... 2005-359036

(51) Int. Cl.
*H01F 1/08* (2006.01)
*H01F 1/20* (2006.01)

(52) U.S. Cl. ..... 148/108; 148/103

(58) Field of Classification Search ..... None
See application file for complete search history.

(56) References Cited

U.S. PATENT DOCUMENTS

| | | | |
|---|---|---|---|
| 6,984,270 | B2 | 1/2006 | Sato et al. |
| 2003/0118467 | A1 | 6/2003 | Sato et al. |
| 2006/0022782 | A1 | 2/2006 | Sato et al. |
| 2007/0151629 | A1 | 7/2007 | Sato et al. |
| 2007/0170801 | A1 | 7/2007 | Sato et al. |

FOREIGN PATENT DOCUMENTS

| | | | |
|---|---|---|---|
| EP | 1 717 828 | A1 * | 11/2006 |
| JP | 2004-111944 | A | 4/2004 |

* cited by examiner

*Primary Examiner*—John P Sheehan
(74) *Attorney, Agent, or Firm*—Westerman, Hattori, Daniels & Adrian, LLP

(57) ABSTRACT

A radially anisotropic magnet is prepared by furnishing a cylindrical magnet-compacting mold comprising a die, a core, and top and bottom punches, packing a magnet powder in the mold cavity, applying a magnetic field across the magnet powder, and forcing the top and bottom punches to compress the magnet powder for compacting the magnet powder by a horizontal magnetic field vertical compacting process. The top punch is divided into segments so that the magnet powder may be partially compressed; in the step of compacting the magnet powder packed in the mold cavity by a horizontal magnetic field vertical compacting process, the magnet powder is partially compressed by the segments of the top punch cooperating with the bottom punch for thereby consolidating the partially compressed zones of magnet powder to a density from 1.1 times the packing density to less than the compact ultimate density; and thereafter, the entire magnet powder in the cavity is compressed under a pressure equal to or greater than that of partial compression by the entire top and bottom punches for finally compacting the magnet powder.

4 Claims, 4 Drawing Sheets

METHOD FOR PREPARING RADIALLY ANISOTROPIC MAGNET

TECHNICAL FIELD

This invention relates to a method for preparing radially anisotropic magnets.

BACKGROUND ART

Anisotropic magnets produced by milling crystalline magnetic anisotropy materials such as ferrites or rare-earth alloys and pressing the milled material in a specific magnetic field are widely used in speakers, motors, measuring instruments and other electrical devices. Of these, in particular, magnets with anisotropy in a radial direction are endowed with excellent magnetic properties, are freely magnetizable and require no reinforcement to fix the magnet in place as in the case of segment magnets, finding use in AC servomotors, DC brushless motors and other related applications. The trend in recent years toward higher motor performance has brought with it a demand for elongated radially anisotropic magnets. Magnets having a radial orientation are manufactured by vertical compacting in a vertical magnetic field or by backward extrusion. The vertical magnetic field, vertical compacting process is characterized by applying opposing magnetic fields through the core of a mold in the pressing direction so as to provide a radial orientation.

FIG. 1 illustrates a vertical magnetic field vertical compacting system for producing a radially anisotropic magnet. Illustrated in FIG. 1 are a compactor housing 1, coils 2 for generating orienting magnetic fields, a die 3, a top core 4, a bottom core 5, a top punch 6, a bottom punch 7, and a packed magnet powder 8. In this vertical magnetic field vertical compacting system (compactor), the magnetic fields generated by the coils create magnetic paths extending from the cores, through the die and the compactor housing and back to the cores. To reduce magnetic field leakage loss, a ferromagnet, typically a ferrous metal is used as the material making up the portions of the compactor that form the magnetic paths. However, the strength of the magnet powder-orienting magnetic field is determined as follows. Assume that B is a core diameter (magnet powder packed cavity inside diameter), A is a die diameter (magnet powder packed cavity outside diameter), and L is a magnet powder packed cavity height. Magnetic fluxes which have passed through the top and bottom cores meet from opposite directions at the core center, run against each other and divert into the die. The quantity of magnetic flux that passes through the core is determined by the saturation magnetic flux density of the core while an iron core has a magnetic flux density of about 20 kG. Therefore, the orienting magnetic fields at inside and outside diameters of a magnet powder packed cavity are obtained by dividing the quantity of magnetic flux which has passed through the top and bottom cores by the inside surface area and outside surface area of the magnet powder packed cavity, respectively. They are expressed by the following equations.

$$2\cdot\pi\cdot(B/2)^2\cdot 20/(\pi\cdot B\cdot L)=10\cdot B/L \text{ (inner periphery)}$$

$$2\cdot\pi\cdot(B/2)^2\cdot 20/(\pi\cdot A\cdot L)=10\cdot B^2/(A\cdot L) \text{ (outer periphery)}$$

Because the magnetic field is smaller at the outer periphery than at the inner periphery, a magnetic field of at least 10 kOe is required at the outer periphery in order to obtain good orientation in all areas of the magnet powder packed cavity. As a result, $10\cdot B^2/(A\cdot L)=10$, and so $L=B^2/A$. Given that the height of the powder compact is about one-half the height of the packed powder and is further reduced to about 80% during sintering, the magnet ultimately obtained has a very small height. Because the height of the magnet that can be oriented is dependent on the core shape, it is difficult to produce lengthy magnets by the method of producing a radial magnet in opposed magnetic fields using the vertical magnetic field vertical compacting system.

The backward extrusion process is not conducive to the production of low-cost magnets because of a large scale of equipment and low yields.

Thus, regardless of which process is used, radially anisotropic magnets are difficult to manufacture. The inability to achieve the low-cost, large-volume production of such magnets has in turn made motors that use radially anisotropic magnets very expensive to manufacture.

In order to manufacture a large number of elongated annular radial magnets in a multiple-cavity molding manner, the applicant proposed in JP-A 2004-111944 a method of manufacturing such radial magnets, without using a prior art vertical magnetic field vertical press, by applying a magnetic field in a horizontal magnetic field vertical press with a ferromagnetic core set in place, rotating the magnet powder relative to the magnetic field direction, applying a magnetic field again, and compacting, that is, "a method of manufacturing radially anisotropic ring magnets in which a magnet powder packed into a cavity in a cylindrical magnet-forming mold having a core composed at least in part of a ferromagnetic material with a saturation magnetic flux density of at least 5 kG is pressed under the application of an orienting magnetic field by a horizontal magnetic field vertical compacting process; the method being characterized by carrying out at least one of the following operations (i) to (v):

(i) rotate the magnet powder a given angle in the circumferential direction of the mold during application of the magnetic field, (ii) rotate the magnet powder a given angle in the circumferential direction of the mold following application of the magnetic field, then again apply a magnetic field, (iii) rotate a magnetic field-generating coil a given angle in the circumferential direction of the mold with respect to the magnet powder during application of the magnetic field, (iv) rotate a magnetic field-generating coil a given angle in the circumferential direction of the mold with respect to the magnet powder following application of the magnetic field, then again apply a magnetic field, (v) use a plurality of coil pairs to first apply a magnetic field with one coil pair, then apply a magnetic field with the other coil pair so as to apply to the magnet powder a magnetic field from a plurality of directions rather than one direction and pressure compaction, for thereby manufacturing a radially anisotropic ring magnet having throughout the magnet an angle of 80° to 100° between a center axis thereof and a radial anisotropy imparting direction."

In this method, the magnetic field applied by placing a ferromagnetic core in a horizontal magnetic field press takes a radial orientation near a magnetic field applying direction as shown in FIG. 3*b*. At this point, it does not take a radial orientation in a direction perpendicular to the magnetic field applying direction. Then the packed magnet powder and the magnetic field applying direction are rotated relatively, after which a weaker magnetic field is applied to impart a radial orientation to those sites which have not taken radial orientation during the previous magnetic field application. Use of such a weaker magnetic field causes no disorders to the orientation in a direction perpendicular to the magnetic field applying direction. In this way, radial orientation is imparted throughout the circumferential direction. However, if the strength of the magnetic field applied immediately before compaction is too high, the radial orientation which has been established thus far is disordered in a direction perpendicular to the magnetic field. Also, if the strength is too low, the disordered orientation which has been induced during the latest application of a magnetic field in the magnetic field applying direction cannot be corrected into radial orientation. Therefore, whether or not uniform radial orientation is achieved largely depends on the strength of a magnetic field applied immediately before compaction. There thus exists a desire to have a more consistent production method.

Patent Reference 1: JP-A 2004-111944

DISCLOSURE OF THE INVENTION

Problem to Be Solved by the Invention

An object of the present invention, which has been made in view of the above-discussed circumstances, is to provide a method of manufacturing a series of lengthy uniform radially anisotropic magnets with excellent magnetic properties in a simple, mass-scale, consistent manner at low costs.

Means for Solving the Problem

The present invention that achieves the above and other objects provides a method of manufacturing a radially anisotropic magnet, comprising the steps of furnishing a cylindrical magnet-compacting mold comprising a die having a cylindrical hollow interior, a cylindrical core disposed in the hollow interior to define a cylindrical cavity, and top and bottom punches disposed for vertical sliding motion within the cavity, packing a magnet powder in the cavity, applying a magnetic field across the magnet powder from outside the die and along a radial direction of the core, and forcing the top and bottom punches to compress the magnet powder for compacting the magnet powder by a horizontal magnetic field vertical compacting process, wherein at least the top punch is divided into segments so that the magnet powder may be partially compressed in zones arcing an angle from ±10° to ±80° circumferentially from the magnetic field applying direction, the core of the magnet-compacting mold is composed at least in part of a ferromagnetic material with a saturation magnetic flux density of at least 0.5 T, the step of compacting the magnet powder packed in the mold cavity by a horizontal magnetic field vertical compacting process includes pre-compaction in which the magnet powder is partially compressed in zones arcing an angle from ±10° to ±80° circumferentially from the magnetic field applying direction during or after application of an orienting magnetic field across the magnet powder, by the segments of the top punch corresponding to the zones cooperating with the bottom punch, for thereby consolidating the partially compressed zones of magnet powder to a density from 1.1 times the packing density prior to the magnetic field application to less than the compact ultimate density, and thereafter, at least one of the following operations (i) to (iii):

(i) subsequent to the magnetic field application, to rotate the magnet powder a given angle in the circumferential direction of the mold, then again apply a second magnetic field, (ii) subsequent to the magnetic field application, to rotate a magnetic field-generating coil a given angle in the circumferential direction of the mold relative to the magnet powder, then again apply a second magnetic field, and (iii) subsequent to the magnetic field application, to select a pair of coils shifted a given angle relative to the pair of coils which have been used for the magnetic field application, then again apply a second magnetic field therefrom, during or after application of the second magnetic field, or optionally after the pre-compaction and at least one of operations (i) to (iii) are repeated, the entire magnet powder is compressed under a pressure equal to or greater than that of partial compression by the entire top and bottom punches for finally compacting the magnet powder.

In a preferred embodiment, the magnetic fields applied during the pre-compaction and final compaction or prior to the pre-compaction and final compaction both have a strength of 159.5 kA/m to 797.7 kA/m. In a preferred embodiment, the top punch is equally divided into 4, 6 or 8 segments. If necessary, the bottom punch may also be divided, and in this embodiment, it is preferred that divided segments of the bottom punch correspond to the divided segments of the top punch. Specifically, in a preferred embodiment, the bottom punch is divided into segments so that the magnet powder may be partially compressed in zones arcing an angle from ±10° to ±80° circumferentially from the magnetic field applying direction, and the segments of the top punch cooperate with the corresponding segments of the bottom punch for achieving partial compression of the magnet powder.

BENEFITS OF THE INVENTION

The method of manufacturing radially anisotropic magnets according to the invention facilitates to manufacture a series of lengthy parts and enables the low-cost, large-volume, consistent supply of uniform radially anisotropic magnets with excellent magnetic properties. The invention is thus of great worth for utilization in the industry.

BEST MODE FOR CARRYING OUT THE INVENTION

The invention is illustrated in further detail.

Figure 1A:
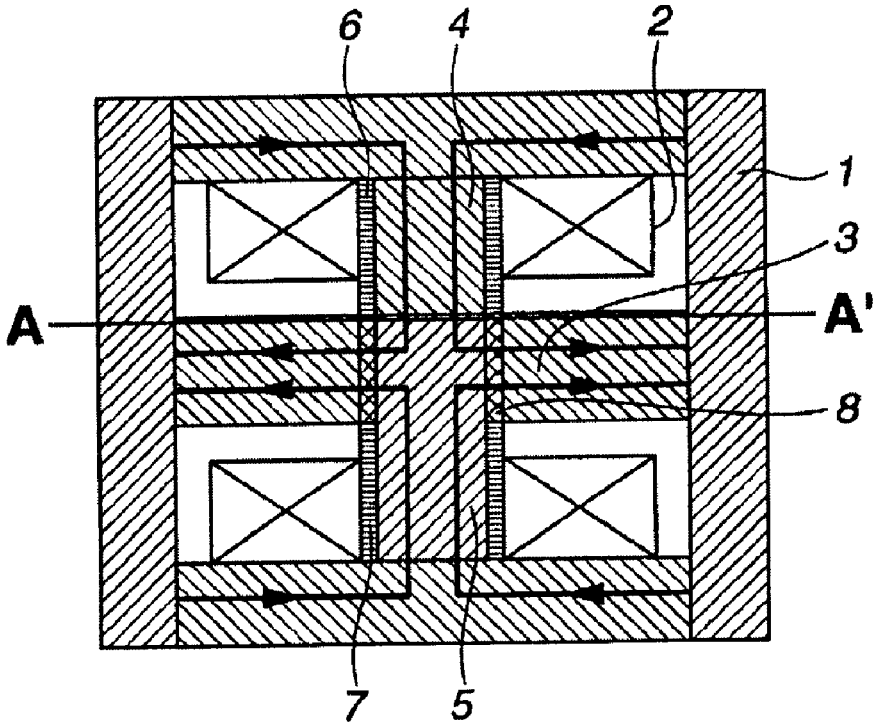
FIG.1A PRIOR ART
FIG. 1 illustrates a prior-art vertical magnetic field-generating vertical-compacting system used to manufacture radially anisotropic cylindrical magnets, FIG. 1*a* being a longisectional view, and FIG. 1*b* being a cross-sectional view taken along line A-A' in FIG. 1*a*.
Figure 1B:
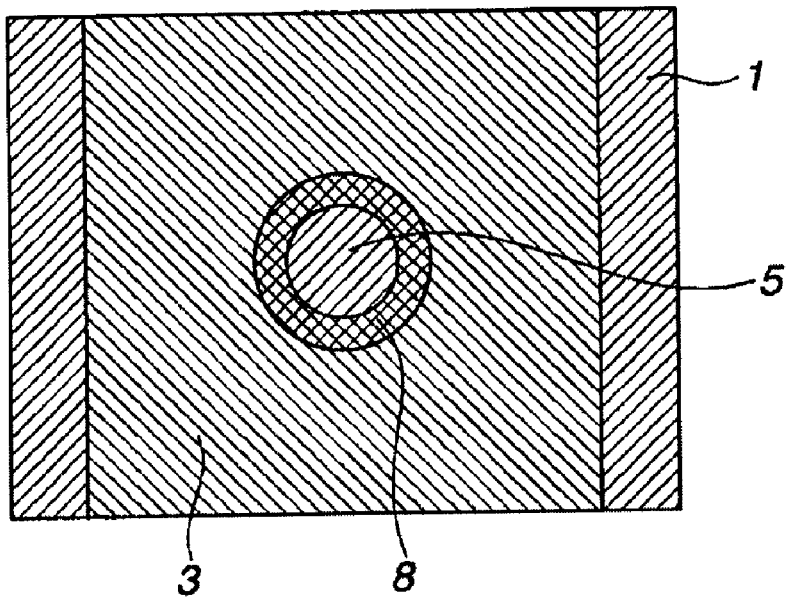
FIG.1B PRIOR ART
Figure 2A:
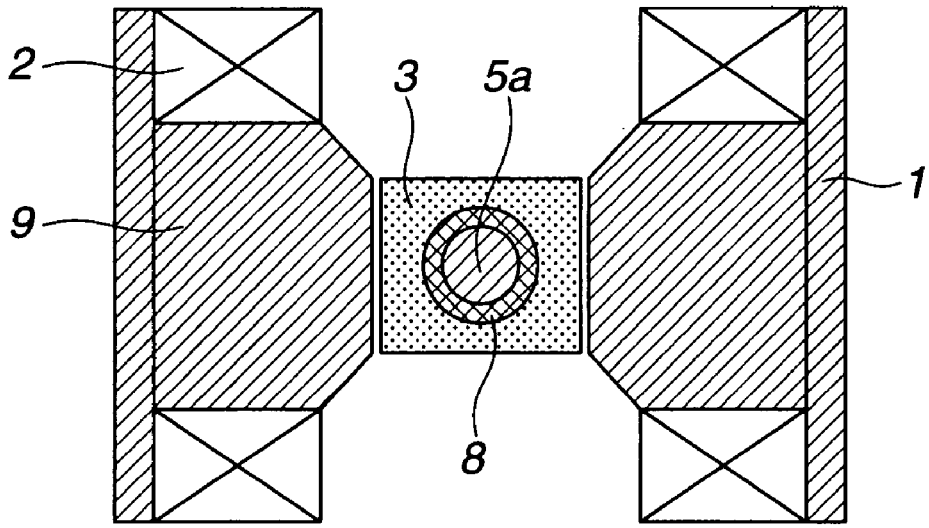
FIG. 2 illustrates a horizontal magnetic field-generating vertical-compacting system used to manufacture cylindrical magnets, FIG. 2*a* being a plan view and FIG. 2*b* being a longisectional view.
Figure 2B:
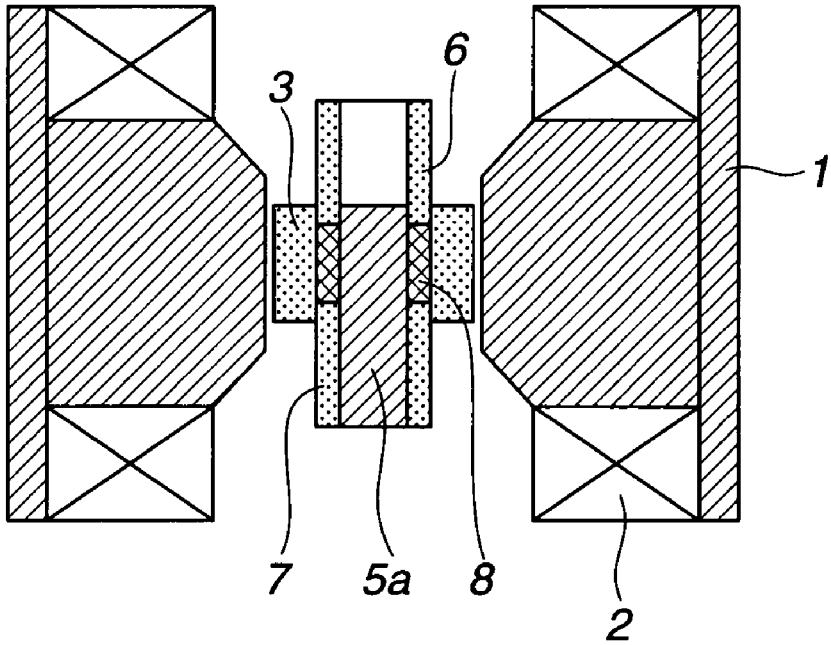

FIG. 2 is a schematic view of a horizontal magnetic field-generating vertical compacting system for compacting a cylindrical magnet while performing orientation in a magnetic field, and especially a horizontal magnetic field-generating vertical compacting system for producing motor-use magnets. Like FIG. 1, FIG. 2 illustrates a compactor housing 1, coils 2 for generating orienting magnetic fields, a die 3, a core 5*a*, a top punch 6, a bottom punch 7, a packed magnet powder 8, and pole pieces 9.

Specifically, die 3 has a cylindrical hollow interior, into which cylindrical core 5*a* having a smaller diameter than the diameter of the hollow interior is inserted to define a cylindrical cavity between die 3 and core 5*a*. This cavity is filled with magnet powder 8, which is compacted into a magnet having a shape conformal to the cavity. Top and bottom punches 6 and 7 are inserted for vertical sliding motion into the cavity and cooperate to compress magnet powder 8 packed in the cavity. To the magnet powder packed in the cavity, a magnetic field is applied from outside die 3 and along a radial direction of core 5*a*.

In the embodiment of the invention, the top punch is divided into segments so that the magnet powder may be partially compressed in zones arcing an angle from ±10° to ±80°, and preferably from ±30° to ±60° circumferentially from the magnetic field applying direction. In this embodiment, the bottom punch is preferably integral without division although it may be divided as is the top punch.

Also in the embodiment of the invention, at least part and preferably all of core 5*a* in the mold is formed of a ferromagnetic material having a saturation magnetic flux density of at least 0.5 Tesla (5 kiloGauss), preferably 0.5 to 2.4 T (5 to 24 kG), and more preferably 1.0 to 2.4 T (10 to 24 kG). Suitable core materials include magnetic materials such ferrous materials, cobalt base materials, iron-cobalt base alloys, and alloys thereof.

Figure 3A:
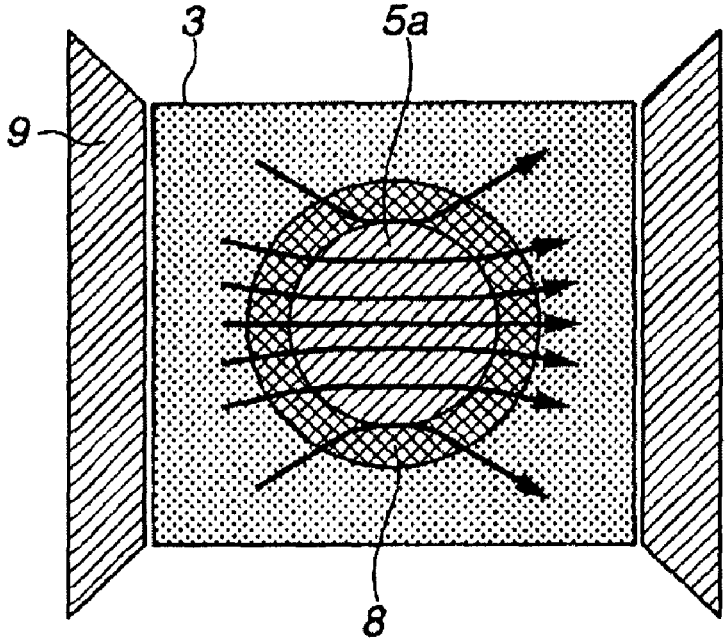
FIG. 3 schematically illustrates the lines of magnetic force when a magnetic field is generated by a horizontal magnetic field-generating vertical-compacting system during the production of a cylindrical magnet, FIG. 3*a* being a system according to the invention and FIG. 3*b* being a prior art system.
Figure 3B:
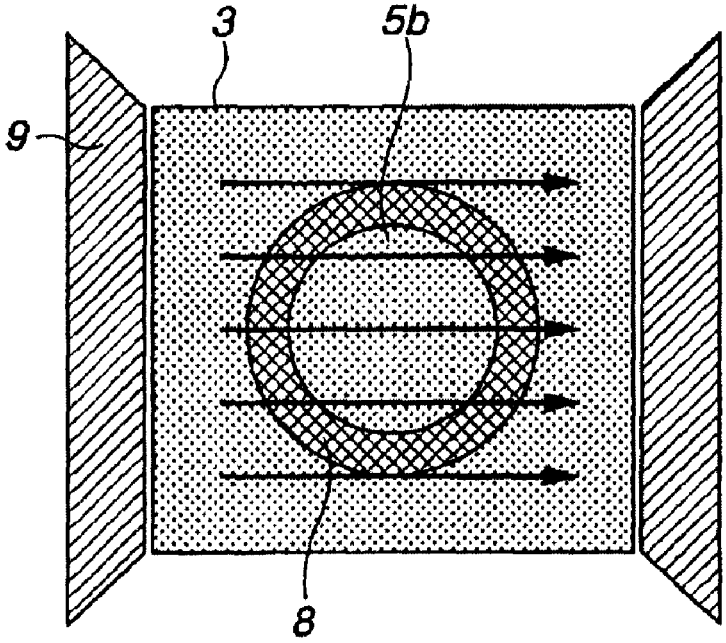
FIG.3B PRIOR ART

The use of a ferromagnet having a saturation flux density of at least 0.5 T in the core ensures that when an orienting magnetic field is applied to the magnet powder, the magnetic flux tries to enter the ferromagnet surface perpendicularly, creating lines of magnetic force that are nearly radial. Thus, as shown in FIG. 3*a*, the direction of the magnetic field in the magnet powder packed region can be made close to a radial orientation. By contrast, in the prior art, the core 5*b* is made of a material which is either nonmagnetic or has a saturation magnetic flux density comparable to that of the magnet powder. In this case, as shown in FIG. 3*b*, the lines of magnetic force are mutually parallel; in the diagram, although the lines of magnetic force do extend in the radial direction near the center, toward the upper and lower sides they merely extend in the direction of the orienting magnetic field generated by the coils. Even when the core is made of a ferromagnet, it is readily saturated if its saturation flux density is less than 0.5 T. Then, even though a ferromagnetic core is used, the magnetic field will be in a state close to that shown in FIG. 3*b*. In addition, a saturation flux density of less than 0.5 T for the core will be equal to the saturation flux density of the packed magnet powder [(saturation flux density of magnet)×(packing density of magnet powder)/(true density of magnet)] and the direction of magnetic flux within the packed magnet powder and the ferromagnetic core becomes the same as the direction of the magnetic field generated by the coils. The use of a ferromagnet having a saturation flux density of at least 0.5 T as part of the core provides effects similar to those described above and is thus effective, although it is preferable for the entire core to be made of a ferromagnet of at least 0.5 T.

In a direction orthogonal to the orienting magnetic field generated by the coils, no radial orientation is assumed in some cases. Where a ferromagnet exists in a magnetic field, the magnetic flux tends to enter the ferromagnet perpendicularly and is attracted by the ferromagnet. The magnetic flux density increases in a plane of the magnetic field direction of the ferromagnet, but decreases in a perpendicular direction. As a consequence, where a ferromagnetic core is located within a mold, the magnet powder packed therein is given a satisfactory orientation by the strong magnetic field in a portion of the magnetic field direction of the ferromagnetic core, but little orientation in a perpendicular direction portion. To compensate for this, the magnet powder is rotated relative to the magnetic field generated by the coils whereby the incompletely oriented portion is oriented again by the strong magnetic field portion in the magnetic field direction.

However, the magnetic field applied at this point, if strong, causes the radial orientation to be disordered again in a direction perpendicular to the applied magnetic field direction; and if too weak, fails to correct the radial orientation which has been disordered in the magnetic field applying direction. Therefore, whether or not uniform radial orientation is acquired largely depends on the strength of the magnetic field immediately before compaction, making it difficult to manufacture magnets in a consistent manner.

Then, in the present invention, while the radial orientation in the magnetic field applying direction is once established during the magnetic field application or immediately thereafter, pre-compaction is carried out by applying pressure by the top or bottom punch or both top and bottom punches, which is or are divided into segments so that only selected segments can be driven, thereby restraining the magnet powder from rotating even when a magnetic field other than the radial direction is applied. Then, by multi-stage compaction including pre-compaction during application of the first magnetic field and final compaction by way of application of a rotating magnetic field(s), a compact having uniform radial orientation is obtainable. Pre-compaction and final compaction may also be carried out after the magnetic field application, but preferably in the magnetic field because higher orientation is accomplished.

In the description of zones subject to pre-compaction, since directions of 0° and 180° relative to the magnetic field applying direction are identical, zones of ±90° cover 360°, that is, the overall zone.

The compression point during pre-compaction should be within zones of at least ±10° from the magnetic field applying direction. If zones are narrower than this limit, there could be sites where radial orientation is disordered by application of a magnetic field during final compaction. If the compression point during pre-compaction exceeds ±80° from the magnetic field applying direction, pre-compaction spreads to the proximity of the vertical direction of the applied magnetic field, meaning that pre-compaction is performed even in those portions which have not been radially oriented. For this reason, pre-compaction may be performed in zones of up to ±80° and preferably in zones from ±30° to ±60°.

The punch is equiangularly divided into at least 4 segments, and preferably into 4, 6 or 8 segments. Problems arise if the number of division is more than 8. Where the number of punch division is even, the number of pre-compaction operations may be one-half of the number of punch division, and a larger number of division leads to an extended cycle time. In the case of odd division, the number of pre-compaction operations is equal to the number of division, leading to an extended cycle time which is detrimental to productivity.

With respect to the punch division, it is preferred that the top punch be divided as mentioned above, and the bottom punch be of the cylindrical shape as in the prior art. However, it is acceptable that both top and bottom punches are divided.

Where the number of punch division is large enough, it is unlikely that radial orientation is disordered by application of a magnetic field during final compaction and that the portions which have not been oriented are compacted. In order to perform pre-compaction in portions exceeding the divided compaction zones, the number of division must be increased, thus prolonging the compaction cycle time. Then the number of division is preferably equal to or less than 8.

The extent of compression during pre-compaction should be at least 1.1 times the packing density. If the compression is to a less extent, the radial orientation can be disordered by application of a magnetic field during final compaction, despite pre-compaction being performed. If compression during pre-compaction achieves a density above the ultimate density of magnet powder during final compaction, density variations can be introduced in the compact after final compaction, causing cracks and deformation. Thus the extent of compression should be less than the ultimate density of magnet powder during final compaction. Preferably the extent of compression during pre-compaction should range from 1.3 times the packing density to 90% of the compact ultimate density.

Now the magnetic field to be applied to the magnet powder is described. If the horizontal magnetic field-generating vertical-compacting system generates a stronger magnetic field, for example, the core 5*a* in FIG. 3*a* becomes saturated and assumes a state close to that shown in FIG. 3*b*. That is, the orienting magnetic field approaches the magnetic field of a radially oriented cylindrical magnet rather than a radial orientation. It is then preferred that the magnetic field generated immediately before or during compression have a strength of not more than 797.7 kA/m (10 kOe). When a ferromagnetic core is used, the magnetic flux concentrates in the core, creating in the vicinity of the core a magnetic field which is stronger than the magnetic field generated by the coils. However, if the magnetic field is too weak, a magnetic field sufficient for orientation will not be achieved even in the vicinity of the core. In a direction perpendicular to the magnetic field applying direction, the pre-compaction includes a step of rotation to provide a radial orientation again, and in the case of final compaction, the pre-compacted state ensures that orientation is unsusceptible to disordering by a magnetic field. Then the magnetic field generated by the coils preferably has a strength equal to or more than 159.5 kA/m (2 kOe) at which sufficient radial orientation is achieved in the magnetic field applying direction having not assumed a radial orientation before the magnetic field application.

The phrase "magnetic field generated by the horizontal magnetic field-generating vertical-compacting system" refers herein to the magnetic field in places at a sufficient remove from the ferromagnet, or to magnetic field values measured in the absence of the ferromagnetic core.

In the practice of the invention, the mold cavity is first packed with a predetermined amount of the magnet powder, and a magnetic field of 159.5 to 797.7 kA/m (2 to 10 kOe) is applied (referred to as magnetic field application). At the same time or after the magnetic field application, preferably during the magnetic field application, the zones of magnet powder arcing from ±10° to ±80°, and preferably from ±30° to ±60° are compressed (partially compressed) by top punch segments corresponding to the zones and the bottom punch (or bottom punch segments corresponding to the zones if the bottom punch is divided) whereby the partially compressed portions 10 are compacted (pre-compacted) to a density from 1.1 times the packing density of magnet powder prior to the magnetic field application to less than the compact ultimate density, preferably from 1.3 times the packing density to 90% of the compact ultimate density. Accordingly, the partially compressed (pre-compacted) portions 10 of magnet powder are consolidated to the above-specified density while the non-partially-compressed portions of magnet powder remain in the initial powder state.

Next, at least one of the following operations (i) to (iii) is carried out (rotation and magnetic field application):

(i) subsequent to the magnetic field application, to rotate the magnet powder a given angle in the circumferential direction of the mold, then again apply a second magnetic field, (ii) subsequent to the magnetic field application, to rotate a magnetic field-generating coil a given angle in the circumferential direction of the mold with respect to the magnet powder, then again apply a second magnetic field, and (iii) subsequent to the magnetic field application, to select a pair of coils shifted a given angle relative to the pair of coils which have been used for the magnetic field application, then again apply a second magnetic field therefrom.

The angle of rotation is selected as appropriate. Preferably rotation is performed such that the angle of not more than ±10° is included between the central direction of non-pre-compacted zones and the magnetic field direction. The magnetic field applied at this time is as in the previous application.

In the course of steps including magnetic field application, pre-compaction, rotation, magnetic field application, and final compaction, at least one series of steps of pre-compaction, rotation and magnetic field application may be included prior to the final compaction for the purpose of further improving the degree of radial orientation.

At the end of final compaction, the compact should desirably have an ultimate density (weight/volume of compact) of 3.0 to 4.7 g/cm$^3$, and more desirably 3.5 to 4.5 g/cm$^3$.

As described above, in the practice of the invention, it is preferable to carry out partial compression compaction a plurality of times. There may be used either the procedure of compacting while applying a magnetic field, or the procedure of once applying a magnetic field, then interrupting the magnetic field application, and compacting although the former procedure of compacting while applying a magnetic field is preferred. The magnetic field to be applied preferably has a strength of 2 to 10 kOe in either of the procedures.

Whether or not the compact obtained takes a radial orientation depends on the magnetic field applied during pre-compaction or final compaction. With respect to magnetic field application other than those during pre-compaction and final compaction, it is acceptable to apply a magnetic field in excess of 797.7 kA/m (10 kOe).

According to the invention, partial compression is performed on the magnet powder once or plural times, prior to final compaction. The final compaction is performed by compressing the entire magnet powder uniformly under a pressure equal to or greater than that of partial compression and by the entire top and bottom punches. Specifically, in accordance with the ordinary horizontal magnetic field vertical compacting process, the magnet powder is compacted under an ordinary pressure of 0.29 to 1.96 Pa (0.3 to 2.0 t/cm$^2$) while applying an orienting magnetic field thereto, followed by sintering, aging treatment, working and the like, yielding a sintered magnet.

The magnet powder used herein is not particularly limited. The invention is well-suited to the manufacture of Nd—Fe—B-based cylindrical magnets and also effective in manufacturing ferrite magnets, Sm—Co-based rare-earth magnets and various types of bonded magnets. In any case, compaction is preferably carried out using an alloy powder having an average particle size of 0.1 to 100 μm, and especially 0.3 to 50 μm.

EXAMPLE

Examples and Comparative Examples are given below for further illustrating the invention, but the invention is not limited thereto.

Examples 1 to 3

Figure 4:
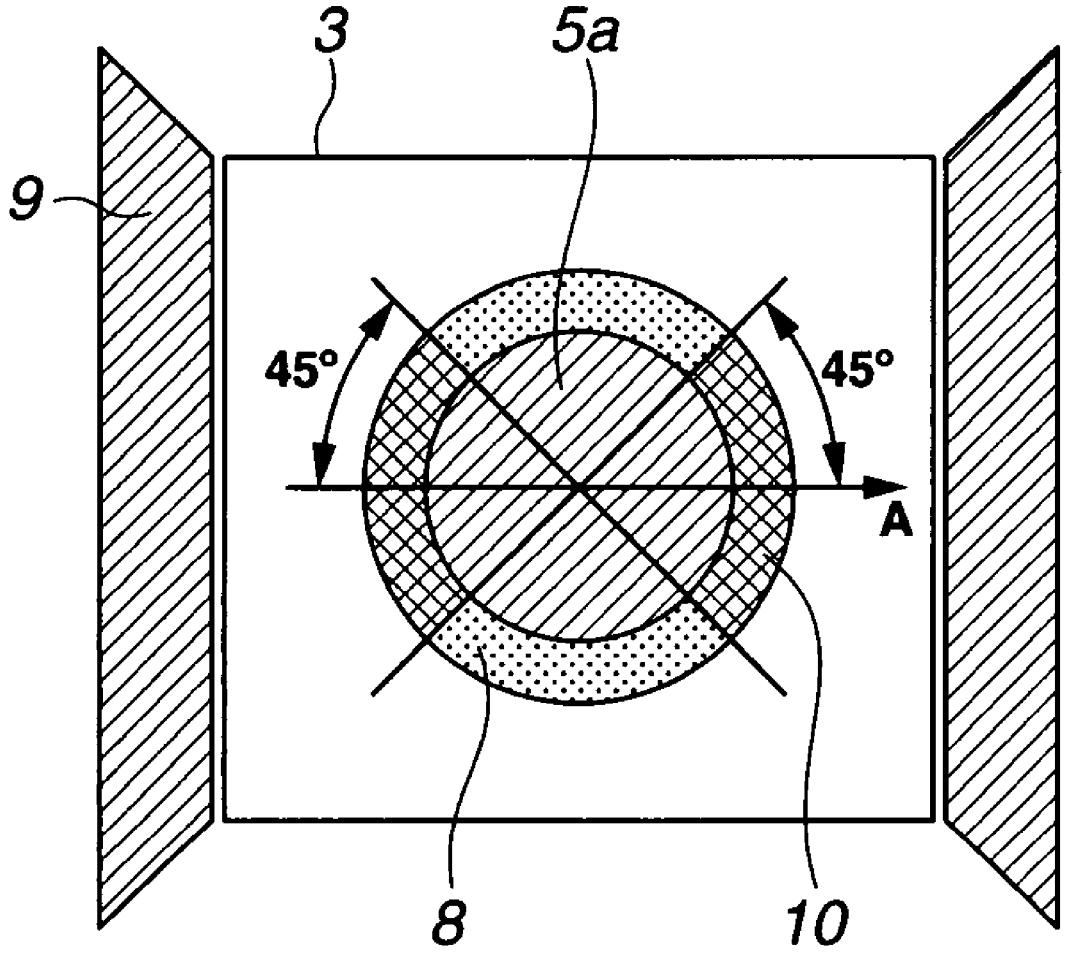
FIG. 4 illustrates the state after pre-compaction in a compacting system used for manufacturing a cylindrical magnet.

Nd, Dy, Fe, Co, and M (M stands for Al, Si and Cu), each of 99.7 wt % purity and B of 99.5 wt % purity were used. An ingot of alloy $Nd_{30}Dy_{2.5}Fe_{62.8}Co_3B_1Al_{0.3}Si_{0.3}Cu_{0.1}$ (expressed in wt %) was prepared by melting and casting in a vacuum melting furnace. The ingot was crushed on a jaw crusher and a Brown mill, then reduced to a fine powder with an average particle size of 4.8 μm on a jet mill in a nitrogen stream. The powder was packed in a horizontal magnetic field-generating vertical-compacting system, as shown in FIG. 2, with a ferromagnetic core of iron having a saturation magnetic flux density of 1.9 T (19 kG) mounted in place, to a packing density of 2.66 g/cm$^3$. The top punch was divided into four segments, and the bottom punch was an undivided cylindrical one. While a coil-generated magnetic field of 638.2 kA/m (8 kOe) was applied, the magnet powder in zones of ±45° relative to the magnetic field direction was compressed by the top punch segments opposed to these zones cooperating with the bottom punch. This pre-compaction continued until the compressed zones of magnet powder reached a density of 3.46 g/cm$^3$ which was 1.3 times the packing density. FIG. 4 illustrates the state of the magnet powder within the cavity after the pre-compaction. Arrow A denotes the applied magnetic field direction. Thereafter, the coils were rotated 90°, the magnet powder was oriented again in a magnetic field of 398.8 kA/m (5 kOe), and final compaction was carried out under a compaction pressure of 0.49 Pa using the overall top and bottom punches. The resulting compact had a density of 4.18 g/cm$^3$.

Example 2 used the same magnet powder as in Example 1. A horizontal magnetic field-generating vertical-compacting system was packed with the magnet powder to a packing density of 2.28 g/cm$^3$. While the magnet powder was oriented under a coil-generated magnetic field of 478.6 kA/m (6 kOe), the magnet powder in zones of ±45° relative to the magnetic field direction was compressed by the top punch segments cooperating with the bottom punch. This pre-compaction continued until the compressed zones of magnet powder reached a density of 3.42 g/cm$^3$ which was 1.5 times the packing density. The magnet powder was rotated 90° together with the die, core and punches. Then in a magnetic field of 319.1 kA/m (4 kOe), final compaction was carried out under a compaction pressure of 0.49 Pa (0.5 t/cm$^2$) using the overall top and bottom punches. The resulting compact had a density of 4.18 g/cm$^3$.

In Example 3, the top punch was divided into six segments, and the bottom punch was an undivided cylindrical one. The same magnet powder as in Example 1 was used and packed to a packing density of 2.9 g/cm$^3$. In a horizontal magnetic field-generating vertical-compacting system, the magnet powder was oriented under a coil-generated magnetic field of 877.5 kA/m (11 kOe). The magnet powder was rotated 90° together with the die, core and punches and oriented again under a coil-generated magnetic field of 797.7 kA/m (10 kOe). The magnet powder was further rotated 90° together with the die, core and punches and a magnetic field of 398.8 kA/m (5 kOe) was applied, after which the magnet powder in zones of ±60° relative to the last-applied magnetic field direction was compressed by the top punch segments and the bottom punch. This pre-compaction continued until the compressed zones of magnet powder reached a density of 3.34 g/cm$^3$ which was 1.15 times the packing density. Thereafter the magnet powder was rotated 90° together with the die, core and punches. Then the magnetic powder was similarly oriented again in a magnetic field of 398.8 kA/m (5 kOe), and final compaction was carried out under a compaction pressure of 0.39 Pa (0.4 t/cm$^2$) using the overall top and bottom punches. The resulting compact had a density of 3.8 g/cm$^3$.

Each of the compacts was sintered in vacuum at 1,090° C. for one hour and subsequently heat-treated at 530° C. for one hour, obtaining a cylindrical magnet with an outside diameter of 30 mm, an inside diameter of 25 mm and a length of 30 mm. On the sintered magnet, no cracks, chips or substantial deformation were observed. Samples measuring 2 mm in a circumferential direction and 2.5 mm in a cylinder axial direction were cut out of the sintered cylindrical magnet. Note that the samples were cut out of the cylindrical magnet center at five positions spaced apart 0°, 45°, 90°, 135°, and 180° from the magnetic field applying direction during final compaction which is assumed 0° (herein, 180° is also the magnetic field applying direction). The samples were measured for residual magnetization Br (T) using a vibrating sample magnetometer VSM. The results are shown in Table 1.

Comparative Examples 1 to 4

Comparative Example 1 used the same conditions as in Example 1 except the pre-compaction. The magnet powder was compacted without pre-compaction.

Comparative Example 2 used the same conditions as in Example 1 except the pre-compaction. Pre-compaction was performed in the overall zone (±90°) before a compact was produced.

In Comparative Example 3, the pre-compacted zones of magnet powder in Example 2 had a density of 2.39 g/cm$^3$ which is 1.05 times the packing density. Otherwise as in Example 2, a compact was produced.

In Comparative Example 4, pre-compaction was performed until the pre-compacted zones of magnet powder in Example 3 reached a density of 4.56 g/cm$^3$. Otherwise as in Example 3, a compact having an overall density of 4.30 g/cm$^3$ was produced. In 50% of compacts, cracking and chipping occurred.

As in Examples, each of the compacts of Comparative Examples was sintered in vacuum at 1,090° C. for one hour and subsequently heat-treated at 530° C. for one hour, obtaining a cylindrical magnet with an outside diameter of 30 mm, an inside diameter of 25 mm and a length of 30 mm. In 45% of the sintered bodies of Comparative Example 4, cracks were observed, and all they were observed to have been substantially deformed. On the remaining magnets, no cracks, chips or substantial deformation were observed. Samples measuring 2 mm in a circumferential direction and 2.5 mm in a cylinder axial direction were cut out of the sintered cylindrical magnet. Note that the samples were cut out of the cylindrical magnet center at five positions spaced apart 0°, 45°, 90°, 135°, and 180° from the magnetic field applying direction during final compaction which is assumed 0° (herein, 180° is also the magnetic field applying direction). The samples were measured for residual magnetization Br (T) using a vibrating sample magnetometer VSM. The results are shown in Table 1 together with the results of Examples.

TABLE 1

| Br (T) | 0° | 45° | 90° | 135° | 180° |
|---|---|---|---|---|---|
| Example 1 | 1.24 | 1.23 | 1.23 | 1.23 | 1.24 |
| Example 2 | 1.23 | 1.22 | 1.23 | 1.22 | 1.23 |
| Example 3 | 1.21 | 1.21 | 1.21 | 1.20 | 1.21 |
| Comparative Example 1 | 1.21 | 0.98 | 0.62 | 0.93 | 1.22 |
| Comparative Example 2 | 0.67 | 0.95 | 1.23 | 1.01 | 0.66 |
| Comparative Example 3 | 1.23 | 1.19 | 1.04 | 1.21 | 1.23 |
| Comparative Example 4 | 1.20 | 1.19 | 1.19 | 1.18 | 1.20 |

It is seen from Table 1 that Examples 1 to 3 exhibit high residual magnetization and minimal variations between different positions as compared with Comparative Examples 1 to 3. In contrast to the low productivity of Comparative Example 4 as demonstrated by cracks and chips on the compact, radially anisotropic magnets can be effectively produced by the method of Examples 1 to 3 or equivalent methods.

Examples 4 and 5

In Example 4, Nd, Dy, Fe, Co, and M (M stands for Al and Cu), each of 99.7 wt % purity and B of 99.5 wt % purity were used. An ingot of alloy $Nd_{30}Dy_{2.8}Fe_{63.9}Co_{1.9}B_1Al_{0.2}Cu_{0.2}$ (expressed in wt %) was prepared by melting and casting in a vacuum melting furnace. The ingot was crushed on a jaw crusher and a Brown mill, then reduced to a fine powder with an average particle size of 4.5 μm on a jet mill in a nitrogen stream. The powder was packed in a horizontal magnetic field-generating vertical-compacting system, as shown in FIG. 2, with a ferromagnet core of iron having a saturation magnetic flux density of 1.9 T (19 kG) mounted in place, to a packing density of 2.66 g/cm$^3$. The top and bottom punches each were divided into six segments, all equal to 60°. A coil-generated magnetic field of 717.8 kA/m (9 kOe) was applied. Then, while a magnetic field of 319.0 kA/m (4 kOe) was applied again, the magnet powder in zones of ±30° relative to the magnetic field direction was compressed by the top and bottom punch segments (two segments for each of top and bottom) opposed to these zones. This pre-compaction continued until the compressed zones of magnet powder reached a density of 3.46 g/cm$^3$ which was 1.3 times the packing density. Thereafter, the coils were rotated 60°; then similarly, a magnetic field of 717.8 kA/m (9 kOe) was applied; and subsequently, while a magnetic field of 319.0 kA/m (4 kOe) was applied again, the magnet powder in zones of ±30° relative to the magnetic field direction was compressed by the top and bottom punch segments (two segments for each of top and bottom) opposed to these zones. This pre-compaction continued until a density of 3.46 g/cm$^3$ was reached. Thereafter, the coils were rotated 60° in the same direction as above; and the magnet powder was oriented again in a magnetic field of 398.8 kA/m (5 kOe), and final compaction was carried out under a compaction pressure of 0.49 Pa using the overall top and bottom punches. The resulting compact had a density of 4.1 g/cm$^3$.

Example 5 used the same magnet powder as in Example 4. The mold included top and bottom punches which were of the same shape as in Example 4 and divided into eight segments at an equal angle of 45°. It was packed with the magnet powder to a packing density of 2.4 g/cm$^3$. While a coil-generated magnetic field of 398.8 kA/m (5 kOe) was applied, the magnet powder in zones of ±22.5° relative to the magnetic field direction was compressed by two pairs of the top and bottom punch segments opposed to these zones. This pre-compaction continued until a density of 3.6 g/cm$^3$ which was 1.5 times the packing density was reached. Thereafter, the coils were rotated 45°; then while a magnetic field of 398.8 kA/m (5 kOe) was applied, the magnet powder in zones of ±22.5° relative to the magnetic field direction was compressed by two pairs of the top and bottom punch segments opposed to these zones. This pre-compaction continued until a density of 3.6 g/cm$^3$ was reached. Thereafter, the coils were rotated 45° in the same direction as above; then while a magnetic field of 398.8 kA/m (5 kOe) was applied, the magnet powder in zones of ±22.5° relative to the magnetic field direction was compressed by two pairs of the top and bottom punch segments opposed to these zones. This pre-compaction continued until a density of 3.6 g/cm$^3$ was reached. Thereafter, the coils were rotated 45°; and the magnet powder was oriented again in a magnetic field of 398.8 kA/m (5 kOe), and final compaction was carried out under a compaction pressure of 0.6 Pa using the overall top and bottom punches. The resulting compact had a density of 4.3 g/cm$^3$.

Each of the compacts was sintered in vacuum at 1,080° C. for one hour and subsequently heat-treated at 500° C. for one hour, obtaining a cylindrical magnet with an outside diameter of 50 mm, an inside diameter of 45 mm and a length of 30 mm. On the magnet, no cracks, chips or substantial deformation were observed. Samples measuring 2 mm in a circumferential direction and 2.5 mm in a cylinder axial direction were cut out of the sintered cylindrical magnet. Note that the samples were cut out of the cylindrical magnet center at seven positions spaced apart 0°, 30°, 60°, 90°, 120°, 150°, and 180° from the magnetic field applying direction during final compaction which is assumed 0° (herein, 180° is also the magnetic field applying direction) in Example 4 and at nine positions spaced apart 0°, 22.5°, 45°, 67.5°, 90°, 112.5°, 135°, 157.5°, and 180° from the magnetic field applying direction during final compaction which is assumed 0° (herein, 180° is also the magnetic field applying direction) in Example 5. The samples were measured for residual magnetization Br (T) using a vibrating sample magnetometer VSM. The results are shown in Tables 2 and 3.

TABLE 2

| Br (T) | 0° | 30° | 60° | 90° | 120° | 150° | 180° |
|---|---|---|---|---|---|---|---|
| Example 4 | 1.28 | 1.28 | 1.29 | 1.28 | 1.29 | 1.28 | 1.28 |

TABLE 3

| Br (T) | 0° | 22.5° | 45° | 67.5° | 90° | 112.5° | 135° | 157.5° | 180° |
|---|---|---|---|---|---|---|---|---|---|
| Example 5 | 1.27 | 1.27 | 1.28 | 1.27 | 1.27 | 1.27 | 1.27 | 1.27 | 1.27 |

Each of the magnets obtained in Examples 4 and 5 was magnetized at 10 poles and inserted into a 12-slot stator, after which a torque ripple at 3 rpm and an induced electromotive force were measured. Example 4 had a torque ripple of 9.6 mNm and an induced electromotive force of 7.1 V/krpm. Example 5 had a torque ripple of 8.9 mNm and an induced electromotive force of 6.9 V/krpm.

It is evident from Tables 2 and 3 that Examples 4 and 5 exhibit high residual magnetization and minimal variations between different positions. In addition, the motor characteristics are excellent, demonstrating that radially anisotropic magnets suited for DC brushless motors and AC servo motors are manufactured.

The invention claimed is:

1. A method of manufacturing a radially anisotropic magnet, comprising the steps of furnishing a cylindrical magnet-compacting mold comprising a die having a cylindrical hollow interior, a cylindrical core disposed in the hollow interior to define a cylindrical cavity, and top and bottom punches disposed for vertical sliding motion within the cavity, packing a magnet powder in the cavity, applying a magnetic field across the magnet powder from outside the die and along a radial direction of the core, and forcing the top and bottom punches to compress the magnet powder for compacting the magnet powder by a horizontal magnetic field vertical compacting process, wherein at least the top punch is divided into segments so that the magnet powder may be partially compressed in zones arcing an angle from ±10° to ±80° circumferentially from the magnetic field applying direction, wherein said segments can be individually driven, the core of the magnet-compacting mold is composed at least in part of a ferromagnetic material with a saturation magnetic flux density of at least 0.5 T, the step of compacting the magnet powder packed in the mold cavity by a horizontal magnetic field vertical compacting process includes pre-compaction in which the magnet powder is partially compressed in zones arcing an angle from ±10° to ±80° circumferentially from the magnetic field applying direction during or after application of an orienting magnetic field across the magnet powder, by the segments of the top punch corresponding to the zones cooperating with the bottom punch, for thereby consolidating the partially compressed zones of magnet powder to a density from 1.1 times the packing density prior to the magnetic field application to less than an ultimate compact density, and thereafter, at least one of the following operations (i) to (iii):

(i) subsequent to the magnetic field application, to rotate the magnet powder a given angle in the circumferential direction of the mold, then again apply a second magnetic field, (ii) subsequent to the magnetic field application, to rotate a magnetic field-generating coil a given angle in the circumferential direction of the mold relative to the magnet powder, then again apply a second magnetic field, and (iii) subsequent to the magnetic field application, to select a pair of coils shifted a given angle relative to the pair of coils which have been used for the magnetic field application, then again apply a second magnetic field therefrom, during or after application of the second magnetic field, or optionally after the pre-compaction and at least one of operations (i) to (iii) are repeated, the entire magnet powder is compressed under a pressure equal to or greater than that of partial compression by the entire top and bottom punches for finally compacting the magnet powder.

2. A method of manufacturing a radially anisotropic magnet according to claim 1, wherein the magnetic fields applied during the pre-compaction and final compaction or prior to the pre-compaction and final compaction both have a strength of 159.5 kA/m to 797.7 kA/m.

3. A method of manufacturing a radially anisotropic magnet according to claim 1 or 2, wherein the top punch is equally divided into 4, 6 or 8 segments.

4. A method of manufacturing a radially anisotropic magnet according to claim 1 or 2, wherein the bottom punch is divided into segments so that the magnet powder may be partially compressed in zones arcing an angle from ±10° to ±80° circumferentially from the magnetic field applying direction, and the segments of the top punch cooperate with the corresponding segments of the bottom punch for achieving partial compression of the magnet powder.

* * * * *

UNITED STATES PATENT AND TRADEMARK OFFICE

CERTIFICATE OF CORRECTION

PATENT NO. : 7,740,714 B2
APPLICATION NO. : 11/662467
DATED : June 22, 2010
INVENTOR(S) : Koji Sato et al.

It is certified that error appears in the above-identified patent and that said Letters Patent is hereby corrected as shown below:

On the Title page:
In item (75) & item 12 change

"(75) Inventors: Koji Sati, Echizen (JP); Mitsuo"

To be

--(75) Inventors: Koji Sato, Echizen (JP); Mitsuo--

Signed and Sealed this

Twenty-eighth Day of September, 2010

David J. Kappos

David J. Kappos
*Director of the United States Patent and Trademark Office*